United States Patent [19]

Plumadore

[11] 4,197,970

[45] Apr. 15, 1980

[54] ELECTROSTATIC DRIVE SYSTEM

[75] Inventor: John D. Plumadore, Westfield, Mass.

[73] Assignee: James River Graphics Inc., South Hadley, Mass.

[21] Appl. No.: 884,681

[22] Filed: Mar. 8, 1978

[51] Int. Cl.[2] ..... B65H 17/28

[52] U.S. Cl. ..... 226/94; 361/234

[58] Field of Search ..... 226/93, 94, 188, 190; 271/193, 18.1, 18.2, DIG. 3; 198/805, 835; 355/16; 361/233, 234

[56] References Cited

U.S. PATENT DOCUMENTS

| | | | |
|---|---|---|---|
| Re. 26,951 | 9/1970 | Vaccaro | 226/94 |
| 2,826,408 | 3/1958 | Beveridge et al. | 226/94 |
| 3,195,363 | 7/1965 | Stuetzer | 361/234 |
| 4,089,034 | 5/1978 | Taylor et al. | 361/233 |

*Primary Examiner*—H. Grant Skaggs

*Attorney, Agent, or Firm*—Joseph H. Yamaoka; John W. Kane, Jr.; William J. Foley

[57] ABSTRACT

An apparatus for transporting a recording medium, such as transparent electrophotographic film, which has a conductive layer, from a supply to a take-up roll. The apparatus includes a drive roller that has a conductive ring. The conductive layer of the film is maintained at a desired potential, generally ground, and a different potential is applied to the conductive ring of the drive roller. When the film contacts the periphery of the drive roller, an electrostatic attractive force is developed between the conductive ring of the drive roller and the conductive layer of the film, thereby allowing the drive roller to transport the film without slip.

9 Claims, 4 Drawing Figures

ELECTROSTATIC DRIVE SYSTEM

The Government has rights in this invention pursuant to Contract Number F33615-76C-1312, awarded by the U.S. Air Force AFSC Aeronautical Systems Division.

BACKGROUND OF THE INVENTION

This invention is generally directed to an apparatus for transporting a recording medium, such as transparent electrophotographic film, which has a conductive layer, from a supply to a take-up roll, and in particular to a transport apparatus in which an electrostatic attractive force is developed between a drive roller and the film. The electrostatic attractive force prevents slip between the surface of the drive roller and the surface of the film. When the drive roller is driven at a constant angular velocity, the film is transported at a constant linear velocity.

In one type of electrophotographic recording process, the recording medium is a film having a polyester base, a transparent conductive layer that overlies the polyester base and a photoconductive layer that overlies the transparent conductive layer. To record on the film, a uniform electrostatic charge is first applied, by means of a charging corona element, to the surface of the photoconductive layer of the film. The uniform charge is then selectively dissipated by exposing the surface to a light image of the pattern to be recorded. The resulting pattern of charges is an electrostatic latent image on the surface of the photoconductive layer which can then be rendered visible, for example, in an attraction toning process, by applying thereto electrostatically charged developer particles which are held to the surface of the photoconductive layer by means of the electrostatic force developed between the developer particles and the charge on the surface of the photoconductive layer. A permanent visible image can be obtained, for example, by using developer particles which can be heat fused to the photoconductive layer, and then subjecting the visible image to a heat fusing step.

It has been found that when electrophotographic film is processed on a reel-to-reel recorder or processor, the conventional techniques for driving the film and the reels have certain shortcomings. Generally, in recording systems in which the recording medium is fed from a supply reel to a take-up reel, drive is applied to the take-up reel or to both the take-up reel and the supply reel. It is also generally required to have the recording medium travel at a constant linear velocity during the recording process, which means that the reels will travel at a variable angular velocity. In one prior art transport system, the recording medium is fed from a supply reel, over a single drive roller member and onto a take-up reel. The drive roller is driven at a constant angular velocity. The periphery of the drive roller is generally made out of hard rubber which is able to develop sufficient frictional force with the recording medium to drive the recording medium without any slip.

In certain electrophotographic film recorders, there is considerable drag on the film as it travels over the recording element and the prior art single roller drive member is unable to develop sufficient frictional force to drive the film without slip. One common approach used in magnetic tape recorders for developing greater frictional force between the drive roller and the tape employs a pinch roller arrangement for driving the tape with a fixed linear velocity. In such recorders, the tape is passed through a nip formed by a free-wheeling roller and a drive roller. The drive roller presses the tape against the free-wheeling roller thereby developing greater frictional force for driving the tape than can be generated by a single drive roller.

One disadvantage of the pinch roller arrangement in an electrophotographic film recorder is that it exerts considerable pressure on the recording surface of the film. Thus, if the pinch roller is located before the recording station so that it pushes film past the recording stations, it is possible for small dirt particles which may exist on the recording surface of the film to be impressed into the recording surface of the film which will prevent the faithful reproduction of images. If the pinch roller is located after the recording station so that film is pulled past the recording station, the pressure on the recording surface may cause damage to the image recorded on the recording surface of the film.

SUMMARY OF THE INVENTION

In the recording medium transport of this invention, electrophotographic film having a conductive layer, is transported from a supply to a take-up roll. The film drive system includes a drive roller that includes a conductive ring. The conductive layer of the film is maintained at a desired potential, generally, ground. A potential, different from the potential of the conductive layer of the film, is applied to the conductive ring of the drive roller when the film is partially wrapped around the periphery of the drive roller, an electrostatic attractive force is developed between the conductive ring of the drive roller and the conductive layer of the film which enables the drive roller to transport the film without any slip between the film and the periphery of the drive roller.

It is an object of this invention to provide an improved transport for feeding a recording medium that has a conductive layer from a supply to a take-up roll.

It is another object of this invention to provide an improved electrophotographic film transport that includes a drive roller wherein an electrostatic attractive force is developed between the drive roller and the film in order to prevent any slip between the drive roller and the film.

It is another object of this invention to provide an improved electrophotographic film transport in which an electrostatic attractive force is developed between a conductive ring of a drive roller and a conductive layer of the film.

DESCRIPTION OF THE DRAWINGS

While the specification concludes with claims particularly pointing out and distinctly claiming that which is regarded as the present invention, the objects and advantages of this invention can be more readily ascertained from the following description of a preferred embodiment when read in conjunction with the accompanying drawings in which:

DETAILED DESCRIPTION

Figure 1:
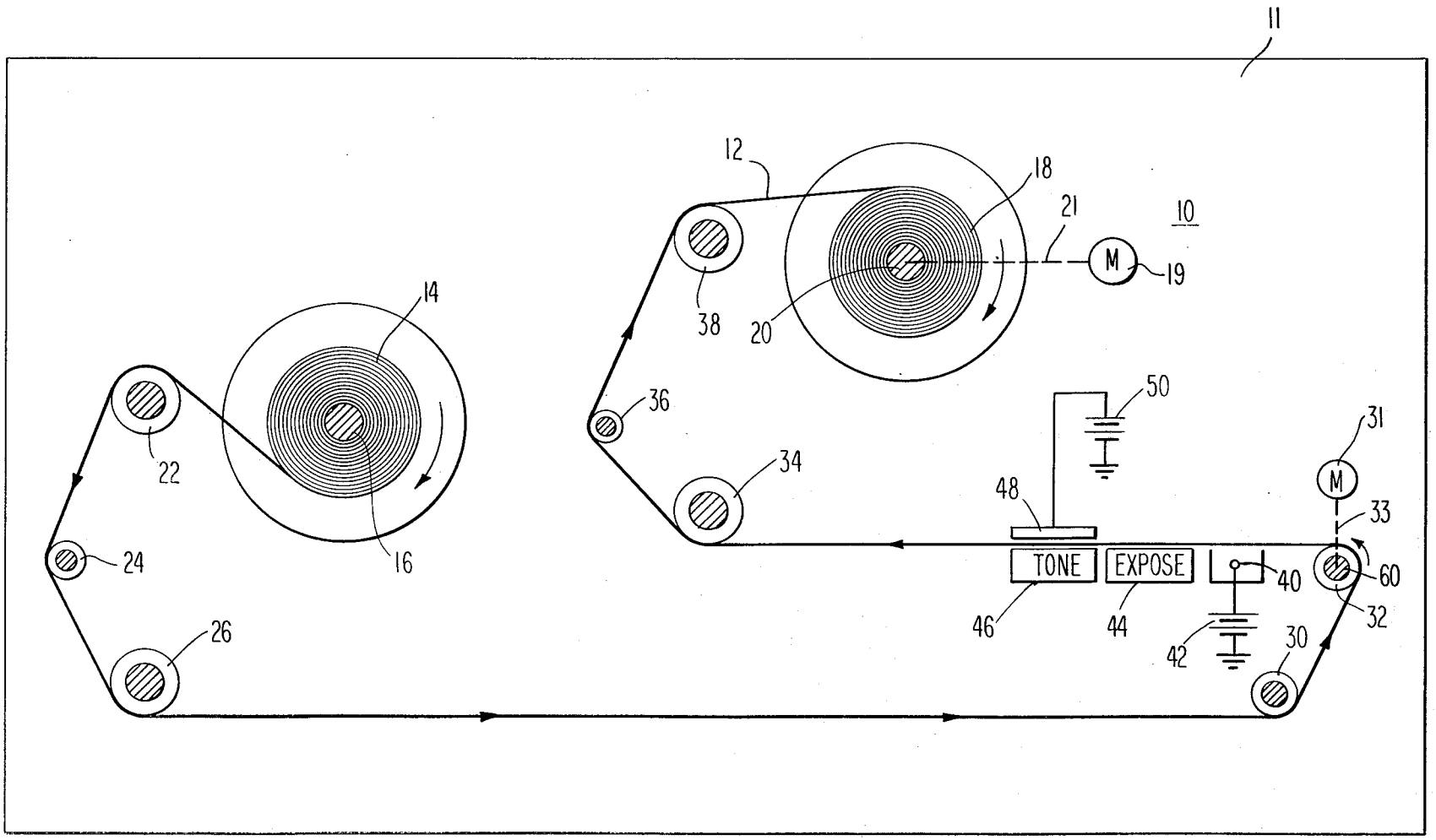
FIG. 1 is a block diagram of a film transport incorporating a drive roller in accordance with the invention.

FIG. 1 is a block diagram of an electrophotographic film recorder 10 that uses the electrostatic drive system of this invention. For the sake of convenience, an element depicted in more than one figure will retain the same element number in each figure. The recording medium 12 is transported from a supply roll 14 around guide rollers 22, 24, 26, 30, then around drive roller 32 and then further around guide rollers 34, 36, 38 onto a take-up roll 18. The supply roll 14 and the take-up roll 18 can either be wound on reels (not shown) or wound directly onto a supply shaft 16 and a take-up shaft 20 respectively. The drive system includes a motor 19 for driving the take-up shaft 20 as indicated by the dashed line 21. Although not shown in the film recorder 10 depicted in FIG. 1, it may be desirable to include a similar motor and drive means for the supply shaft 16. The drive system also includes suitable brake means, not shown, applied to the supply shaft 16 and take-up shaft 20 in order to control the tension on the film 12. The drive roller 32 is mounted on a drive shaft 60 which is driven by a motor 31 as indicated by the dashed line 33.

Figure 4:
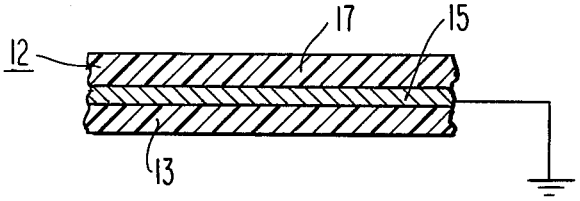
FIG. 4 is a partial cross-sectional view of the recording medium transported by the apparatus of FIG. 1.

The transport system of this invention is intended to transport a recording medium that includes a conductive layer. One example of such a recording medium is schematically represented in FIG. 4 which illustrates an electrophotographic film that has three layers. The first layer 13 of electrophotographic film 12 is a polyester base 13, about 125 micrometers thick, that forms an insulative substrate for the film 12. Overlying the polyester base 13 is a second, transparent conductive layer 15 about 0.01 micrometers thick. The film structure is completed by a photoconductive film matrix 17, about 9 micrometers thick that overlies the transparent conductive layer 15.

Referring now to FIG. 1, in accordance with conventional techniques for recording on electrophotographic film 12, a corona charging unit 40 deposits a uniform distribution of charge on the surface of photoconductive layer 17 of electrophotographic film 12. A conventional high voltage power supply 42 energizes the corona charging unit 40. The uniformly charged film 12 is then transported past an exposure station 44. At the exposure station 44, in accordance with well known techniques, the charged surface of photoconductive layer 17 is subjected to a light pattern that corresponds to the desired image to be recorded on the film 12. Those areas of the charged photoconductive layer 17 that are exposed to the light become conductive and the charge originally deposited on those exposed areas of the photoconductive layer 17 will be dissipated. Those areas of the charged photoconductive layer 17 that are not exposed to light will retain a charge thereon. At this stage of the recording process, the distribution of charge representing the desired image to be recorded is referred to as an electrostatic latent image since it is not visible to the naked eye. In order to provide a visible image, the exposed electrophotographic film 12 is transported past a conventional development or toning unit 46 that subjects the exposed film to charged toner particles which are, in an attraction toning process, attracted to the charged areas of the film 12.

Located adjacent the polyester base 13 of electrophotographic film 12 is an electrode 48 that subtends the area of the film being developed by the toning unit 46. The electrode 48 is also connected to a conventional high voltage power supply 50. The polarity of the potential applied to the electrode 48 is the same as the polarity of the potential applied to corona charging unit 40. One purpose of electrode 48 is to maintain a constant spacing between the exposed surface of electrophotographic film 12 and the toning unit 46. This is accomplished by maintaining the conductive layer 15 of the film 12 at a known potential, such as ground, as illustrated in FIG. 4, and by applying a known potential of about 1500 to 1700 volts to electrode 48 thereby developing an electrostatic attractive force between the surface of electrode 48 and the conductive layer 15 of the film 12. The electrostatic attractive force developed between electrode 48 and film 12 represents significant drag on the film 12 which makes it difficult to develop sufficient frictional force between a conventional prior art single drive roller and the film 12 to prevent the occurrence of slip between the drive roller and the film 12.

Figure 2:
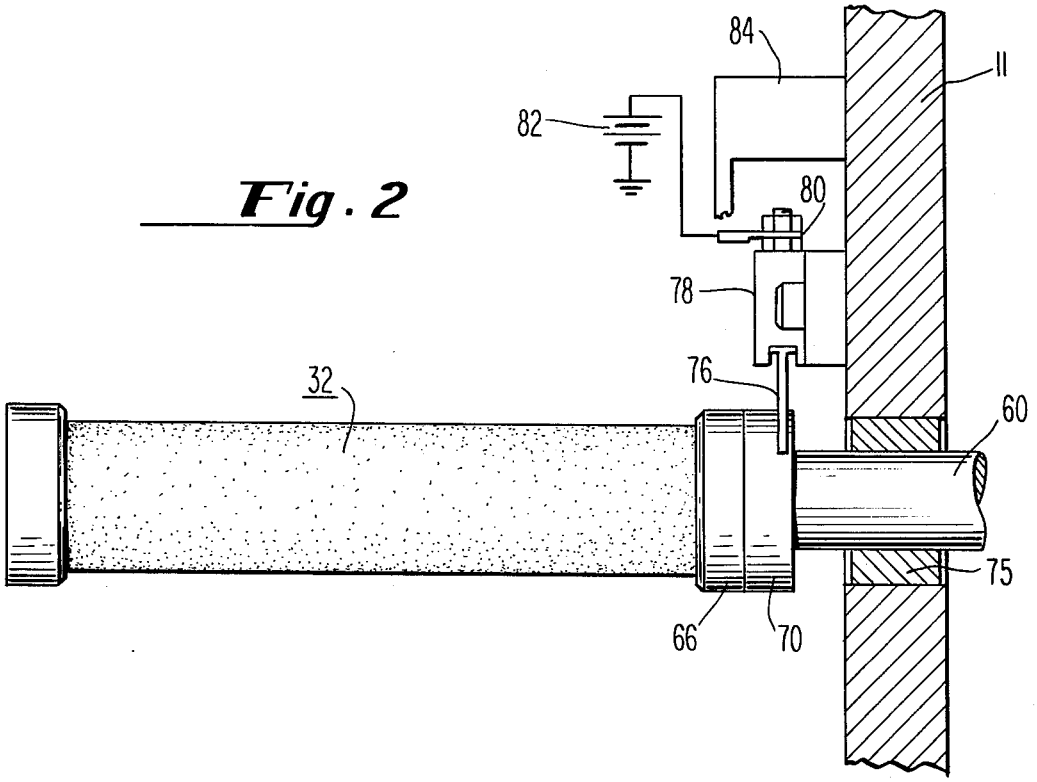
FIG. 2 is a side elevation of the drive roller assembly.
Figure 3:
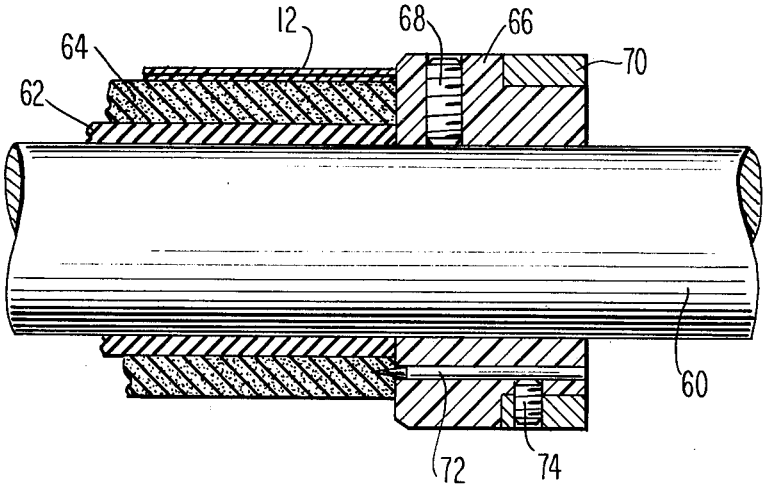
FIG. 3 is an enlarged cross-sectional view of a portion of the drive roller assembly depicted in FIG. 2.

Referring now to FIGS. 2 and 3 there is shown a preferred embodiment of the drive roller 32 of this invention. The outer layer 64 of drive roller member 32 which contacts electrophotographic film 12 is made of a conductive rubber which in a constructed embodiment is a material designated as ARC-616, a conductive neoprene compound having a Durometer Shore A hardness of 65–75, manufactured by Ames Rubber Corporation located in Hamburg, N.J. This material has a surface resistivity of approximately 1000 ohms per square. Other materials that are believed capable of use as the outer layer 64 are conductive silicones such as Y-3087 and K-1516, formerly manufactured by Union Carbide and now marketed by Rhodia, the U.S. division of Rhone-Poulenc, a French company. It is believed that these conductive silicones can be compounded to attain the required conductivity. Nitrile compositions are also believed capable of use as the conductive outer layer 64. Underlying the conductive rubber layer 64 of the drive roller 32 is a layer 62 of insulating material, which in a constructed embodiment, is a material designated as ARC-765 also manufactured by Ames Rubber Corporation. ARC-765, which has a Durometer Shore A hardness of 65–75, contains Nordel, a trademark of E. I. duPont de Nemours, which contains or is derived from ethylene propylene diene monomer. The layer 62 of insulating material is much less conductive than the outer layer 64 and should support about 2000 volts without electrical breakdown. Another material believed to be able to be used for the layer 62 is a material designated as RC-5 also marketed by Rhodia. The central portion of the drive roller 32 is a shaft 60 made, for example, out of stainless steel. The drive roller 32 includes an insulative collar 66 that is secured to shaft 60 by means of a set screw 68. The insulative collar 66 has an axially directed hole 71 that is in alignment with the conductive rubber layer 64. A conductive pin 72 having a sharp point is inserted into hole 71 and is caused to penetrate the conductive rubber layer 64. A conductive slip ring 70 is secured to the insulating collar 66 by means of a conductive set screw 74, which is tightened against conductive pin 72 thereby completing an electrically conductive path between the slip ring 70 and the conductive rubber layer 64 of the drive roller 32.

As shown in FIG. 2, the shaft 60 of drive roller 32 is mounted in a bearing 75 housed in front plate 11 of the film recorder 10. Also mounted on the front plate 11 is a brush holder assembly that includes a brush 76 that makes electrical contact with the slip ring 70. A high voltage power supply 82 is connected to terminal 80 which is electrically connected to the brush 76. Thus, it can be seen that there is provided a continuous electrical path from high voltage power supply 82 to the conductive layer 64 of drive roller 32. In a preferred embodiment the conductive layer 15 of electrophotographic film 12 is maintained at ground. There are several methods, well known in the art, for maintaining the conductive layer 15 of electrophotographic film at a known potential. In one approach, one end of the film, either at the supply or the take-up roll is secured, by means of a conductive tape which makes electrical contact with the conductive layer 15 of the film 12, to a conductive reel or shaft, which in turn is connected to ground potential. An approach for maintaining the conductive layer 15 of electrophotographic film 12 very near ground potential without the need for making physical contact with the conductive layer 15 is described in my copending application, Ser. No. 848,995, filed on Nov. 7, 1977, and assigned to the assignee of this invention.

The voltage applied to the conductive layer 64 of drive roller 32 by power supply 82 is in the range of about 1,000 to about 2,000 volts when the conductive layer 15 of the film 12 is maintained at ground. The electrostatic attractive force developed between the conductive layer 64 of drive roller 32 and the conductive layer 15 of the film 12 is sufficient to allow the drive roller 32 to transport the film 12 at a constant linear velocity of about one inch per second when the shaft 60 is driven at a constant angular velocity.

As shown in FIG. 1, the drive roller 32 is so located that it is pushing film past the toning unit 46. It will be appreciated by those skilled in the art that it may be desirable to locate the drive roller member 32 after the film 12 leaves the toning unit 46 so that the drive roller 32 pulls the film 12 past the charging station 40, the exposure station 44 and the toning station 46. It is also clear that the drive roller 32 can be made to contact the surface of the polyester base 13 instead of the photoconductive surface 17.

In some electrophotographic film recorders a heated roller member is located after the toning station 46 which fuses, or makes permanent the image formed by the deposited toning particles. When the drive roller 32 is located after the toning unit 46 it may be desirable to combine the drive roll function with the fusing function by including means for heating the shaft 60 of the drive roller 32.

While the present invention has been described with reference to a specific embodiment thereof, it will be obvious to those skilled in the art that various changes and modifications may be made without departing from the invention in its broader aspects.

What is claimed as new and desired to be secured by Letters Patent of the United States is:

1. An apparatus for transporting a recording medium from a supply to a take-up means, said medium having an insulative layer, a conductive layer overlying the insulative layer and a photoconductive layer overlying the conductive layer, said apparatus comprising:

(a) means coupled to the conductive layer of the recording medium for maintaining the conductive layer of the recording medium at a first desired potential;

(b) a rotatably mounted roller having a peripheral layer of conductive material that contacts a surface of the recording medium;

(c) a slip ring secured to and rotatable with the roller, the slip ring being electrically connected to the conductive layer of the roller;

(d) a brush for making electrical contact with the slip ring;

(e) a voltage supply electrically connected to the brush for applying a second desired potential to the conductive layer of the roller thereby developing an electrostatic attractive force between the conductive layer of the roller and the conductive layer of the recording medium; and (f) means for driving the roller at a constant angular velocity whereby the recording medium is fed at a constant linear velocity from the supply to the take-up roll.

2. An apparatus as recited in claim 1 wherein the rotatably mounted roller comprises:

(a) a metallic inner shaft;

(b) an insulative layer overling the surface of the metallic shaft;

(c) a peripheral layer of conductive material;

(d) means for electrically insulating the slip ring from the metallic shaft.

3. An apparatus as recited in claim 2 wherein the peripheral layer of the roller is a conductive rubber.

4. An apparatus as recited in claim 3 wherein the peripheral layer of conductive material contacts the photoconductive layer of the recording medium as the medium travels from the supply to the take-up roll.

5. An apparatus as recited in claim 4 wherein the slip ring is mounted on an electrically insulative collar secured to the metal shaft.

6. An apparatus as recited in claim 5 wherein the electrical connection between the slip ring and conductive rubber layer is provided by a pin inserted into the conductive rubber layer and electrically connected to the slip ring.

7. An apparatus as recited in claim 2 wherein the slip ring is mounted on an electrically insulative collar secured to the metal shaft.

8. An apparatus as recited in claim 2 wherein the electrical connection between the slip ring and conductive layer is provided by a pin inserted into the conductive layer and electrically connected to the slip ring.

9. An apparatus as recited in claim 2 wherein the conductive layer of the recording medium is electrically connected to ground potential.

* * * * *